US009908177B2

(12) United States Patent
Sanborn, Jr. et al.

(10) Patent No.: US 9,908,177 B2
(45) Date of Patent: Mar. 6, 2018

(54) METHOD OF MAKING AN OBJECT WITH A METAL-NON-METAL SEAL

(71) Applicant: Raytheon Company, Waltham, MA (US)

(72) Inventors: William B Sanborn, Jr., Chandler, AZ (US); Mitchell N Gross, Sahuarita, AZ (US)

(73) Assignee: Raytheon Company, Waltham, MA (US)

( * ) Notice: Subject to any disclaimer, the term of this patent is extended or adjusted under 35 U.S.C. 154(b) by 649 days.

(21) Appl. No.: 14/282,493

(22) Filed: May 20, 2014

(65) Prior Publication Data

US 2015/0342070 A1 Nov. 26, 2015

(51) Int. Cl.
*B22F 7/06* (2006.01)
*B22F 7/08* (2006.01)
*B22F 7/04* (2006.01)

(52) U.S. Cl.
CPC ..... *B22F 7/08* (2013.01); *B22F 7/04* (2013.01); *B22F 7/06* (2013.01); *B22F 2999/00* (2013.01)

(58) Field of Classification Search
None
See application file for complete search history.

(56) References Cited

U.S. PATENT DOCUMENTS 1,140,135 A 5/1915 Eldred
3,281,931 A * 11/1966 Ritz ..... B22F 7/08 106/1.12
4,492,737 A * 1/1985 Conolly ..... B22F 7/08 29/235
5,678,163 A 10/1997 Rice
6,274,252 B1 * 8/2001 Naugler ..... C03C 27/02 174/152 GM
6,874,423 B2 4/2005 Heeke
2011/0048770 A1 * 3/2011 Reiterer ..... A61N 1/3754 174/152 GM
2012/0306128 A1 * 12/2012 Parker ..... A61N 1/3754 264/614

OTHER PUBLICATIONS

"Powder Metallurgy", Wikipedia, the free encyclopedia, [retrieved online May 20, 2014], <http://en.wikipedia.org/wiki/Powder_metallurgy.
"Metal Injection Molding", Wikipedia, he free encyclopedia, [retrieved online May 20, 2014], <http://en.wikipedia.org/wiki/Metal_injection_molding>.

* cited by examiner

*Primary Examiner* — Jessee Roe
*Assistant Examiner* — Ngoclan T Mai
(74) *Attorney, Agent, or Firm* — Renner, Otto, Boisselle & Sklar, LLP

(57) ABSTRACT

An object is made by sealing a metal body of the part to a nonmetal part of the object. The metal body is formed by a powdered metallurgy process, with the metal body being formed around or with the nonmetal part. Metal powder may be sintered or bonded to form the metal body around the nonmetal part, with the metal body then contracting as it sinters and cools to form the seal around the nonmetal part. The nonmetal part may be a glass or ceramic part, and may include electrical conductors passing through nonmetal part, and sealed in holes in the glass or ceramic. The object may be any of a variety of devices such as an electro-explosive device or an electronics device.

14 Claims, 2 Drawing Sheets

METHOD OF MAKING AN OBJECT WITH A METAL-NON-METAL SEAL

BACKGROUND OF THE INVENTION

Field of the Invention

The invention is in the field of objects having a seal between metal and nonmetal parts.

Description of the Related Art

Objects having metal bodies surrounding nonmetal parts to produce a hermetic seal have been used for electrical feedthroughs in an object. An example of such devices are that shown and described in U.S. Pat. Nos. 5,678,163 and 6,874,423. In such devices the seal may be made by heating the nonmetal part, such as a glass part, to melt the nonmetal material, which then forms a seal against the metal body. An example of a process is shown and described in U.S. Pat. No. 1,140,135.

Prior methods have forming such seals have produced erratic results. Testing is needed to confirm that a desired amount of sealing has been achieved, and the quality of seals has been less than optimum for such reasons as seal failure due to uneven cooling of the object and improper oxidation of the metal.

SUMMARY OF THE INVENTION

According to an aspect of the invention, a metal body provides a seal against a nonmetal part is formed by a powdered metallurgy process.

According to another aspect of the invention, a method of making an object with a metal/nonmetal seal includes the steps of: providing a nonmetal part; and forming a metal body around the nonmetal part, thereby making a seal between the metal body and the nonmetal part. The providing the nonmetal part includes providing an electrical insulator that is attached to and forms a seal with one or more electrical conductors. The providing includes: placing the electrical conductors in holes the electrical insulator; and after the placing, heating the electrical insulator to reflow material of the electrical insulator, to make the seal between the electrical insulator and the one or more electrical conductors.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

The annexed drawings, which are not necessarily to scale, show various aspects of the invention.

DETAILED DESCRIPTION

An object is made by sealing a metal body of the part to a nonmetal part of the object. The metal body is formed by a powdered metallurgy process, with the metal body being formed around or with the nonmetal part. Metal powder may be sintered or bonded to form the metal body around the nonmetal part, with the metal body then contracting as it sinters and cools to form the seal around the nonmetal part. The nonmetal part may be a glass or ceramic part, and may include electrical conductors passing through nonmetal part, and sealed in holes in the glass or ceramic. The object may be any of a variety of devices such as an electro-explosive device or an electronics device.

Figure 1:
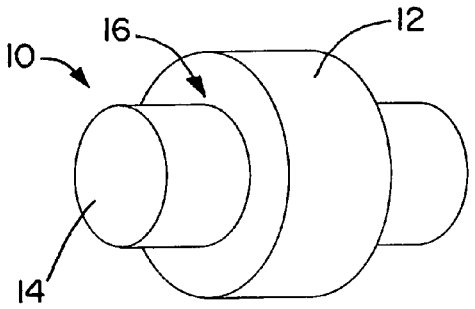
FIG. 1 is an oblique view of an object produced in accordance with a method according to an embodiment of the present invention.

FIG. 1 shows a schematic view of an object 10 that includes a metal body 12 and a nonmetal part 14. The metal body 12 is around the nonmetal part 14 and forms a seal 16 where the parts 12 and 14 are in contact. The object 10 may be any of a variety of objects, with non-limiting examples including electro-explosive devices and electronics devices. Some particular embodiments of the object 10 are discussed below.

Figure 2:
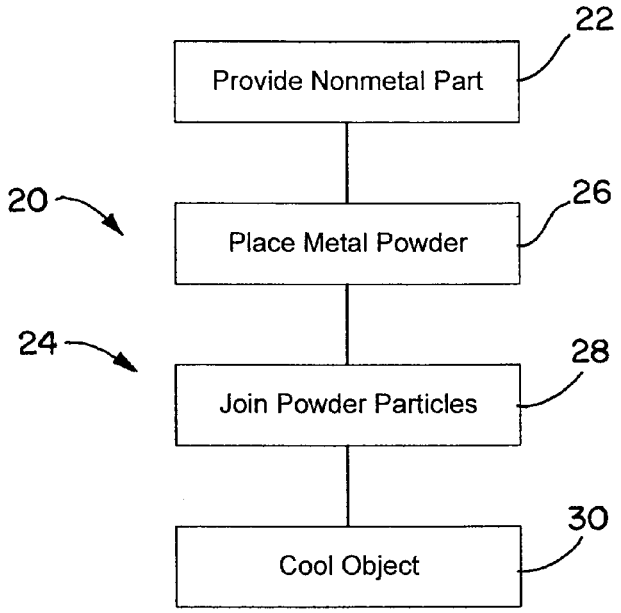
FIG. 2 is a flow chart showing steps of a method according to an embodiment of the present invention.

FIG. 2 shows a broad overview of a method 20 of making the object 10 (FIG. 1), with its metal body (FIG. 1) and nonmetal part 14 (FIG. 1). In step 22 the nonmetal part 14 of the object 10 is provided. The nonmetal part 14 may be (or may include) an electrical insulator, and may be formed in a conventional or nonconventional manner. In step 24 the metal body 12 (FIG. 1) is formed around the nonmetal part 14, with the seal 16 (FIG. 1) produced at the contact between the metal body 12 and the nonmetal part 14. The metal body 12 is formed through powdered metallurgy, with the step 24 breaking down to substeps 26, 28, and 30, for example.

Figure 3:
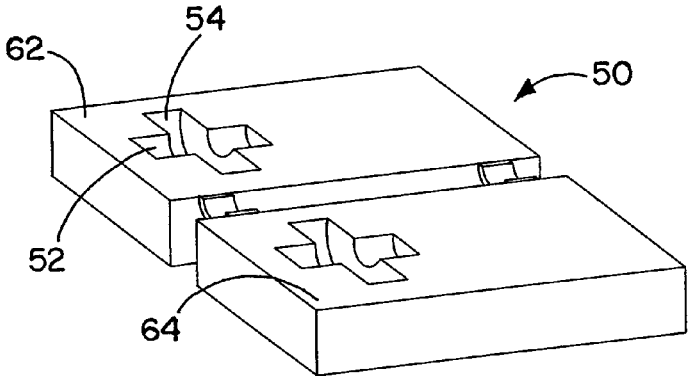
FIG. 3 is an oblique view illustrating a mold which may be used in the method of FIG. 2.

In substep 26 a metal powder is injected or pressed into a mold or die, or otherwise placed around the nonmetal part 14 (FIG. 1) in a mold or other container. The mold or die may have the same overall shape as the metal body 12 (FIG. 1), with provisions made for placement of the nonmetal part 14 at least partially within the mold or die prior to the introduction of the metal powder. FIG. 3 shows an example of a mold 50, with a relatively small cavity 52 for receiving the nonmetal part 14, and a relatively large cavity 54 for forming the metal body 12 around the nonmetal part 14. The mold 50 is shown as a hinged mold, with a pair of hingedly connected mold halves 62 and 64, but many other configurations of the mold 50 are possible, with or without hinges. The metal powder may be injected, or poured, and depending on the powder metallurgy process other materials (additives) may be used in the forming process, such as wax and/or plastic binders. After injection of the powdered material a portion of the binder material may be removed using solvents, heating, and/or catalytic processes.

In substep 28 the metal powder particles are joined together to form the metal body 12 (FIG. 1). This may be done by sintering, a process in which the metal powder is heated to a temperature below the melting temperature of the metal, welding the metal particles together by binding the surfaces of the metal powder particles. Other processes are also possible to densify the metal powder particles. The joining together of the metal particles may occur without any substantial reflowing of the metal material. During the joining together of the metal particles, the metal body 12 may contract as it sinters or densifies.

Finally in substep 30 the metal body 12 (FIG. 1) is cooled, causing it to contract around the nonmetal part 14 (FIG. 1). This contraction tightens the seal 16 (FIG. 1) at the surface between the parts 12 and 14. The cooling may be done by actively cooling the metal body 12, such as with a liquid coolant, or by merely placing the metal body 12 in a relatively cool environment, such as in a room with ambient temperature air.

After the metal body 12 (FIG. 1) has been formed around the nonmetal part 14 (FIG. 1), and the seal 16 (FIG. 1) is formed, further steps may be taken in processing the metal body 12. For example, the metal body 12 may be machined to form features such as threads. Also, other metalworking methods, such as plating, passivating, annealing, carburizing, nitriding, or hardening, may be employed if desired.

The metal body 12 may be made of any of a variety of suitable metals or alloys. Examples of suitable metals include iron, nickel, chromium, molybdenum, aluminum, titanium, cobalt, vanadium, thorium, tantalum, uranium, and suitable alloys of these metals. The metal powder may be initially powderized to micrometer particle size, for example. The injection of the powder may be done at a pressure, 1 psi to 100,000 psi temperature of 80° C.-400° C., and other process parameters to allow complete fill of the mold cavity. Other powder metallurgy process may require other process parameters. The joining together of the metal particles to form the metal part 12 (e.g., the sintering) may also be done under pressure.

Many alternative powdered metal processes may be used in forming the metal body 12. For example die pressing of a powdered metal may be used instead of injection and sintering. Other alternatives are pressing and sintering, hot isostatic pressing, and cold isostatic pressing.

The nonmetal part 14 may be made of any of a variety of materials, such as suitable glasses or ceramics. The nonmetal part 14 may be made of a material that is an electrical nonconductor, to provide electrical insulation to parts embedded in the nonmetal part 14, insulating them from one another and/or from the metal body 12 or other conductors, for example.

The object 10 provides advantages over prior objects with metal-to-nonmetal seals. The seal 16 may be a better seal than prior metal-to-nonmetal seals. For example the seal 16 may reduce leakage by two or three orders of magnitude, relative to the leakage for prior metal-to-nonmetal seals. The seal 16 may also be more reliable, and have a lower rejection rate when tested.

Another advantage of the method 20 for producing the object 10 is that it enables a broader range of materials. In prior methods for producing objects with metal-to-nonmetal seals, there has been a need to closely match coefficients of thermal expansion (CTEs) between the metal and nonmetal, to avoid separation or cracking of the materials, or other changes during cooling which might compromise the integrity of the seal. The method 20 does not have this need for CTE matching, which allows for wider selection of materials for the object 10. Materials for use in the object 10 may be selected for their other advantageous properties, without regard to a need for matching CTEs. For example the mismatch in CTE may be 10% or more, may be 20% or more, may be 50% or more, or may be 1000% or more, of the lower CTE value. Allowing for greater differences in CTE may allow use exotic metals or alloys in combination with traditional nonmetal insulator materials. Example of metal materials that may be used include austenitic nickel-chromium-based superalloys marketed under the trademark INCONEL, and nickel-cobalt ferrous alloys marketed under the trademark KOVAR. The wider range of materials available for the object 10 may allow use of materials that provide high electrical standoff, for example.

As an alternative, the object 10 may be formed by forming both the metal body 12 and the nonmetal part 14 from powders. This may be done in a single mold or container, such as in the mold 50, or may be done in separate molds, dies, or containers, such as one for forming the nonmetal part 14, and one for forming the metal body 12. Powder, such as glass powder, for forming the nonmetal part 14 may be injected before or at the same time as the powder for forming the metal body 12. The non-metal part 14 may be formed from the nonmetal powder in a separate heating step, or may be formed as part of the same step as the sintering or other process that forms the metal body 12. The formation of the nonmetal part 14 from nonmetal powder may include forming the part 14 sealed around preexisting objects, such as electrical contacts. The composition and properties of the non-metal may be chosen such that the non-metal forms a seal with the metal body and the conductor.

Figure 4:
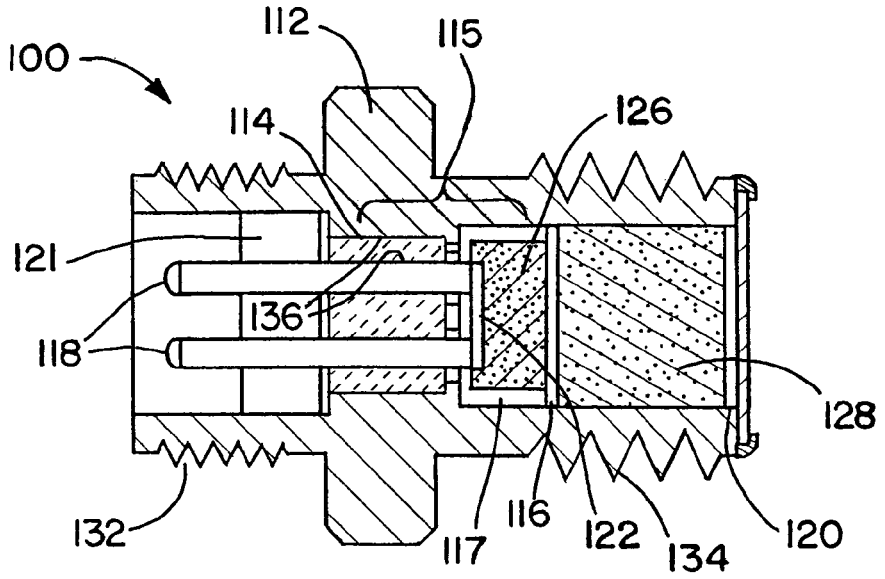
FIG. 4 is a side cross-sectional view of an electro-explosive device, an example of an object producible by the method of FIG. 2.

FIG. 4 shows one example of an object that might be formed as described above, an electro-explosive device 100. The explosive device 100 includes a metal body 112 that contains an integral header 115 that has conductive pins 118 that pass through it, that are insulated from the body 112 by a non-conductive insulator material 114. The pins 118 are connected to a bridge wire 122 that is used to electrically initiate an ignition charge 126, which in turn is used to initiate a detonating or pyrotechnic output charge 128. The output charge 128 may consist of a single material or layers of different materials. The ignition charge material 126 and output charge material 128 may be identical and form a continuous column from ignition to output. The ignition charge 126 and the output charge 128 may (optionally) be separated by another material 116. The ignition charge 126 may (optionally) be isolated from the body 112 by a charge cup 117 that may or may not extend to also isolate the output charge 128 from the body 112. A closure 130 may be used to close off an open end of the metal body 112, preventing exposure of the output charge 128 to the surrounding environment prior to activation. A material or air gap 120 may or may not be present between the closure 130 and the output charge 128. The metal body 112 may include connector features 132 and threads 134 on opposite ends to aid in installation of the device 100 into another assembly and/or connection to an electrical source. A seal 136 between the metal body 112 and the insulator 114 keeps impurities, such as moisture, dirt, and oxygen, from getting into the ignition charge 126 and the output charge 128. A potting/gasket type material 121 may (or optionally may not) be present in the pin end of the device 100. A spark gap (not shown) or other ESD mitigating feature (not shown) may or may not be present in the device 100. The device 100 may be used as to perform work, produce light, produce heat, produce smoke, produce sound, initiate operation, or fire any of a variety of types of devices, including weapons, munitions, airbags, and rocket motors or other propulsive systems, to list a few possible applications. The method described above is used to produce a single assembly by forming the hermetic seal 136 joining the body 112, the pins 118, and the insulator 114. The threads 134 and connector features 132 may be integral to the body 112 or added as a post processing step. All other items may be added in post process operations.

Figure 5:
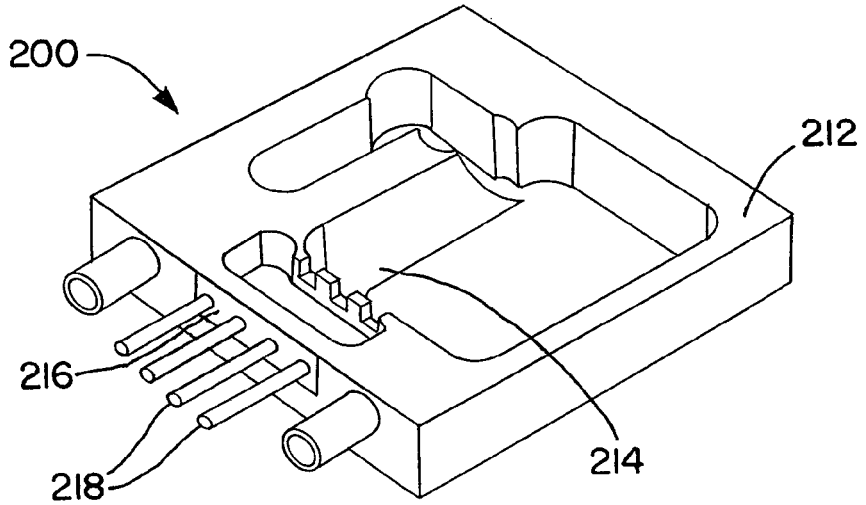
FIG. 5 is an oblique view of an electronics device, another example of an object producible by the method of FIG. 2.

FIG. 5 shows another example of an object, an electronics package 200 that has a metal body housing 212 formed around an interior electronics device 214. The electronics device 214 may be an integrated circuit, sensor, or other electronics enclosed or coated by an electrical insulating material 216, with pins or other contacts 218 exposed for electrical connection to other devices. The metal body 212 may be formed over part of the electronics device 214 by the methods disclosed above.

The methods described herein for making a metal-nonmetal seal may be applied to any of a wide variety of types of objects, only a few of which are described herein. The objects may have various sizes, shapes, configurations, and/or uses.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A method of making an object with a metal/nonmetal seal, the method comprising:

providing a nonmetal part; and forming a metal body around the nonmetal part, thereby making a seal between the metal body and the nonmetal part;

wherein the providing the nonmetal part includes providing an electrical insulator that is attached to and forms a seal with one or more electrical conductors and wherein the providing includes:

placing the electrical conductors in holes of the electrical insulator; and after the placing, heating the electrical insulator to reflow material of the electrical insulator, to make the seal between the electrical insulator and the one or more electrical conductors.

2. The method of claim 1, wherein the forming the metal body includes forming the metal body from metal powder.

3. The method of claim 2, wherein the forming includes injection molding of the metal powder.

4. The method of claim 2, wherein the forming includes sintering the metal powder to join the powder together.

5. The method of claim 4, wherein the sintering is done at a temperature below a melting temperature of the metal powder.

6. The method of claim 4, wherein the sintering also seals the metal body around the nonmetal part, with the metal body contracting against the nonmetal part as the metal body cools after the sintering.

7. The method of claim 2, wherein the forming includes one or more of pressing and sintering, hot isostatic pressing, die pressing, and cold isostatic pressing.

8. The method of claim 1, wherein the coefficient of thermal expansion of the metal body differs by at least 10% from the coefficient of thermal expansion of a portion of the nonmetal part that is in contact with the metal body.

9. The method of claim 1, wherein the providing the nonmetal part includes providing a glass part.

10. The method of claim 1, wherein the providing the nonmetal part includes providing a ceramic material part.

11. A method of making an object with a metal/nonmetal seal, the method comprising:

providing a nonmetal part; and forming a metal body around the nonmetal part, thereby making a seal between the metal body and the nonmetal part;

wherein the providing includes forming the nonmetal part from a nonmetal powder;

wherein the forming the nonmetal part from the nonmetal powder occurs in a mold that is subsequently used in the forming of the metal body around the nonmetal part.

12. The method of claim 11, wherein the nonmetal powder is sintered to form the nonmetal part.

13. The method of claim 11, wherein the metal part is formed from a metal powder that is injected into the mold.

14. The method of claim 13, wherein the metal powder is sintered to form the metal body around the nonmetal part.

* * * * *